US008139019B2

(12) United States Patent
Han et al.

(10) Patent No.: US 8,139,019 B2
(45) Date of Patent: Mar. 20, 2012

(54) BRIGHTNESS ADJUSTING DEVICE AND LIQUID CRYSTAL DISPLAY HAVING THE SAME

(75) Inventors: Song-Yi Han, Yongin-si (KR); Tatsuhisa Shimura, Tokyo (JP); Osamu Sengoku, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 1192 days.

(21) Appl. No.: 11/853,631

(22) Filed: Sep. 11, 2007

(65) Prior Publication Data

US 2008/0062105 A1 Mar. 13, 2008

(30) Foreign Application Priority Data

Sep. 12, 2006 (KR) ..... 10-2006-0088247

(51) Int. Cl.
*G09G 3/36* (2006.01)

(52) U.S. Cl. ..... 345/102; 315/291; 345/77; 345/204; 345/690

(58) Field of Classification Search ..... 345/87–104, 345/690–699, 77, 204; 315/291–311
See application file for complete search history.

(56) References Cited

U.S. PATENT DOCUMENTS

| | | | | |
|---|---|---|---|---|
| 5,422,678 | A * | 6/1995 | Takeuchi | 348/581 |
| 6,724,158 | B1 | 4/2004 | Feldman | |
| 2005/0057170 | A1* | 3/2005 | Yu et al. | 315/167 |
| 2005/0190142 | A1* | 9/2005 | Ferguson | 345/102 |
| 2007/0024574 | A1* | 2/2007 | Wu | 345/102 |
| 2008/0048582 | A1* | 2/2008 | Robinson | 315/291 |
| 2008/0136343 | A1* | 6/2008 | Yu et al. | 315/219 |

FOREIGN PATENT DOCUMENTS

| | | |
|---|---|---|
| EP | 1 387 489 | 3/2006 |
| JP | 07-191298 | 7/1995 |
| JP | 2002-132228 | 5/2002 |
| JP | 2003-173892 | 6/2003 |
| JP | 2003-255913 | 9/2003 |
| JP | 2003-257694 | 9/2003 |
| JP | 2005-316298 | 11/2005 |

OTHER PUBLICATIONS

European Search Report corresponding to EP 07017659.9, Dec. 21, 2007, 4 pages.

* cited by examiner

*Primary Examiner* — Lun-Yi Lao
*Assistant Examiner* — Gene W Lee
(74) *Attorney, Agent, or Firm* — Innovation Counsel LLP

(57) ABSTRACT

A brightness adjusting device includes a multiplication circuit, which multiplies a vertical signal by a predetermined multiplication ratio to output a multiplication signal, a differential circuit that distinguishes between different multiplication signals, a serrated wave generator that charges/discharges a condenser according to a signal output from the differential circuit and generates a serrated wave having constant amplitude independently of a frequency of the multiplication signal, a brightness adjusting voltage generator that generates a reference voltage to determine a pulse duty, and a comparator that outputs a pulse signal by comparing a voltage of the serrated wave with the brightness adjusting voltage. The brightness adjusting voltage generator includes a circuit that outputs a variable voltage, and the multiplication circuit includes a circuit having a variable multiplication ratio.

6 Claims, 9 Drawing Sheets

BRIGHTNESS ADJUSTING DEVICE AND LIQUID CRYSTAL DISPLAY HAVING THE SAME

CROSS-REFERENCE TO RELATED APPLICATION

This application relies for priority upon Korean Patent Application No. 2006-88247 filed on Sep. 12, 2006, the content of which is herein incorporated by reference in its entirety.

BACKGROUND OF THE INVENTION

1. Field of the Invention

The present invention relates to a brightness adjusting device capable of adjusting the brightness of a light source by synchronizing the brightness adjusting pulse with a dimming synchronizing signal of a display apparatus, and a liquid crystal display having the same.

2. Description of the Related Art

A cold cathode fluorescent lamp is commonly used as a backlight source for liquid crystal display devices. In these liquid crystal display devices, the brightness of the backlight is adjusted by controlling the average brightness of the cold cathode fluorescent lamp by changing the duty ratio between a turn-on time and a turn-off time of the cold cathode fluorescent lamp and periodically turning on/off the cold cathode fluorescent lamp. If the turn-off time is shorter than the turn-on time, the brightness becomes high. Conversely, if the turn-off time is longer than the turn-on time, the brightness becomes low. The duty ratio between the turn-on time and the turn-off time of the cold cathode fluorescent lamp is adjusted according to the duty ratio of a pulse signal generated by an inverter circuit that drives the cold cathode fluorescent lamp.

The pulse signal (hereinafter, referred to as a brightness adjusting pulse) can be adjusted through various methods. For instance, the pulse signal can be adjusted by using a differential amplifier (operational amplifier).

FIG. 7 is a circuit diagram showing a conventional brightness adjusting pulse generator. A reference voltage output from a reference voltage generator 701 is input into a positive input terminal of the operational amplifier 704 through a resistor 702. An output of the operational amplifier 704 is transferred to an integration circuit 710 configured with a resistor 705 and a condenser 706, and is put in a positive-fedback loop back to the positive input terminal of the operational amplifier 704 through a resistor 703. In addition, a negative-feedback loop is applied from a node (saw) 711 of the integration circuit 710 to the negative input terminal of the operational amplifier 704, so that the output of the operational amplifier 704 is input into the negative input terminal of the operational amplifier 704. Meanwhile, a brightness adjusting voltage output from a brightness adjusting voltage generator 708 is input into the positive input terminal of an operational amplifier 707 through a level shift 709.

FIGS. 8A to 8D are timing charts showing waveforms at each node of the conventional brightness adjusting pulse generator shown in FIG. 7. FIG. 8A shows the voltage waveform of an output node 712 of the operational amplifier 704, FIG. 8B shows the voltage waveforms of a positive input terminal node (REF) 713 of the operational amplifier 704 and the node (saw) 711 of the integration circuit 710, FIG. 8C shows the voltage waveforms of the node (saw) 711 and a positive input terminal node (A-DIMi) 714 of the operational amplifier 707, and FIG. 8D shows the voltage waveform of an output node 715 of the operational amplifier 707.

The pulse output 801 of the operational amplifier 704 shown in FIG. 8A is integrated by means of the integration circuit 710 including the resistor 705 and the condenser 706, and the node (saw) 711 exhibits a triangular voltage waveform 802, which is linearly changed as shown in FIG. 8B. The node (saw) 711 is fed back into the negative input terminal of the operational amplifier 704 and is compared with a reference voltage 803 input into the positive input terminal of the operational amplifier 704. The signal output from the operational amplifier 704 is put in the positive-feedback loop to the resistors 703, and the output voltage 801 of the operational amplifier 704 is reversed whenever the voltage 802 of the node (saw) 711 reaches the voltage 803 of the node (REF) 713, so that the voltage 803 of the node (REF) 713 is also changed. When the output voltage 801 of the operational amplifier 704 is at the high level, the integration circuit 710 charges the condenser 706 through the resistor 705 and the voltage 802 of the node (saw) 711 is increased. Since the output voltage 801 of the operational amplifier 704 is at the high level, the voltage 803 at the node (REF) 713 that is part of the positive feedback loop including the operational amplifier 704 becomes the high level. In this state, if the voltage 802 of the node (saw) 711 exceeds the voltage 803 of the node (saw) 713, the output of the operational amplifier 704 is reversed and the output voltage of the operational amplifier 704 becomes the low level. When this happens, the electric charges in the condenser 706 of the integration circuit 710 are discharged through the resistor 705. The above procedure repeats, producing the triangular waveform at the node (saw) 711.

The brightness adjusting voltage generated by the brightness adjusting voltage generator is a DC voltage having the brightness level adjusted by the user and is input into the positive input terminal of the operational amplifier 707. The operational amplifier 707 compares the voltage 804 of the positive input terminal node (A-DIMi) 714 of the operational amplifier 707 with the voltage 802 of the node (saw) 711, thereby outputting a brightness adjusting pulse voltage 805.

In general, the frequency of the brightness adjusting pulse is synchronized with the vertical driving signal of the display image signal transmitted to the liquid crystal panel, thereby preventing interference noise and brightness distortion. However, this type of conventional circuit cannot be stabilized due to factors such as an imbalance of the condenser 706, a temperature drift, etc. In addition, when the frequency is synchronized with the vertical driving signal, if the frequency of the input dimming synchronization signal is changed, the amplitude of the triangular wave generated from the integration circuit is changed since the time constant, which is used to determine resistance of the integration circuit and the value of the condenser, is fixed. Then, the dimming control voltage, which is a constant DC voltage, is compared with the triangular wave to change the duty ratio of the dimming control pulse, thereby changing the brightness of the backlight.

The vertical driving signal of the display image signal transmitted to the liquid crystal panel is offset from the frequency of the brightness adjusting pulse, generating interference noise. In particular, if the vertical driving signal of the display image signal that is transmitted to the liquid crystal panel is the common multiple or the common measure of the brightness adjusting pulse, even more interference noise is generated.

There are measures to reduce the interference noise. For example, a dimming control device as disclosed in Japanese Patent Unexamined Publication No. 2003-173892 may be used. FIG. 9 is the circuit diagram of the dimming control device.

The dimming control device shown in FIG. 9 includes an integrator configured with a condenser C5 and a transistor Q4 supplying a charge current, a differential circuit having a reset unit (C4, R7 and D1) that discharges the charge voltage according to a dimming synchronization signal, a transistor Q3, a reference voltage generator, an operational amplifier IC2 that compares the charge voltage of the condenser C5 with the reference voltage and then outputs a pulse signal, a feedback unit that integrates the pulse signal using a resistor R10 and a condenser C6 and then feeds the pulse signal back to a control terminal of the transistor Q4, and an output unit that outputs the dimming control pulse which is obtained by comparing the charge voltage of the condenser C5 with the dimming control voltage using the operational amplifier IC1. The charge voltage waveform of the condenser C5 is a serrated waveform having superior linearity and constant amplitude, and the duty ratio of the dimming control pulse output from the output unit is set proportionally to the dimming control voltage. Therefore, even if the frequency of the dimming synchronization signal is changed, brightness distortion caused by a mismatch between the display driving period of the liquid crystal display and the turn on/off period of the backlight is not generated. In addition, since the duty ratio is proportional to the dimming control voltage, the brightness of the backlight can be stabilized.

However, the dimming control device disclosed in Japanese Patent Unexamined Publication No. 2003-173892 represents a problem in that the frequency of the output dimming control pulse corresponds to the frequency of the dimming synchronization signal.

[Patent Document 1] Japanese Patent Unexamined Publication No. 1995-191298.

[Patent Document 2] Japanese Patent Unexamined Publication No. 2003-173892.

SUMMARY OF THE INVENTION

The present invention provides liquid crystal display having a brightness adjusting device in which the frequency of the dimming synchronization signal is synchronized with the frequency of the brightness adjusting pulse at a fixed magnification to prevent interference noise, the duty ratio of the brightness adjusting pulse is not changed even if the frequency of the dimming synchronization signal is changed, and the frequency of the brightness adjusting pulse may be changed under the control of a multiplication circuit.

In one aspect, a brightness adjusting device includes a multiply multiplication circuit multiplying an input dimming synchronization signal with a multiplication ratio to output a multiplication signal, a detection circuit connected to the multiplication circuit to distinguish between different multiplication signals, a sawtooth wave generator connected to the detection circuit in order to generate a sawtooth wave having constant amplitude independently of the multiplication signal, a first reference voltage generator that generates a first reference voltage, and a comparator connected to the sawtooth wave generator to output a pulse signal by comparing a voltage of the sawtooth wave with the first reference voltage. The first reference voltage generator includes a circuit that outputs a variable voltage, and the multiplication circuit includes a circuit having a variable multiplication ratio.

In another aspect, a liquid crystal display includes a liquid crystal display unit, a gate driver applying a gate signal including two types of gate voltages to a gate line of the liquid crystal display unit, and a data driver that applies a gray scale voltage to a data line, is the gray scale voltage being selected from a gray scale voltage group according to desired brightness and reverse control. In addition, the liquid crystal display includes a voltage generator that generates the gray scale voltage group and two types of gate voltages, a signal controller receiving an RGB image signal and an input control signal that controls the RGB image signal being displayed to generate a plurality of control signals including a dimming synchronization signal, processing image signals in correspondence with operating conditions of the liquid crystal display unit, and outputting the control signals, a lamp including a plurality of discharge tubes, at least one inverter providing the discharge tubes with an AC high voltage, a multiplication circuit receiving and multiplying a dimming synchronization signal to output a multiplication signal, a detection circuit connected to the multiplication circuit to differentiate the multiplication signal, a sawtooth wave generator connected to the detection circuit in order to charge or discharge a condenser according to a signal output from the detection circuit and to generate a sawtooth wave having constant amplitude independently of a frequency of the multiplication signal, a first reference voltage generator that generates a first reference voltage, and a comparator connected to the sawtooth wave generator to output a pulse signal by comparing a voltage of the sawtooth wave with the first reference voltage. The first reference voltage generator includes a circuit that outputs a variable voltage, and the multiplication circuit includes a circuit having a variable multiplication ratio.

BRIEF DESCRIPTION OF THE DRAWINGS

The above and other advantages of the present invention will become readily apparent by reference to the following detailed description when considered in conjunction with the accompanying drawings, wherein.

DESCRIPTION OF THE EMBODIMENTS

Hereinafter, the present invention will be explained in detail with reference to the accompanying drawings. However, the scope of the present invention is not limited to such embodiments and the present invention may be realized in various forms. The embodiments to be described below are provided to aid the disclosure of the present invention and assist those skilled in the art to understand the present invention.

Figure 1:
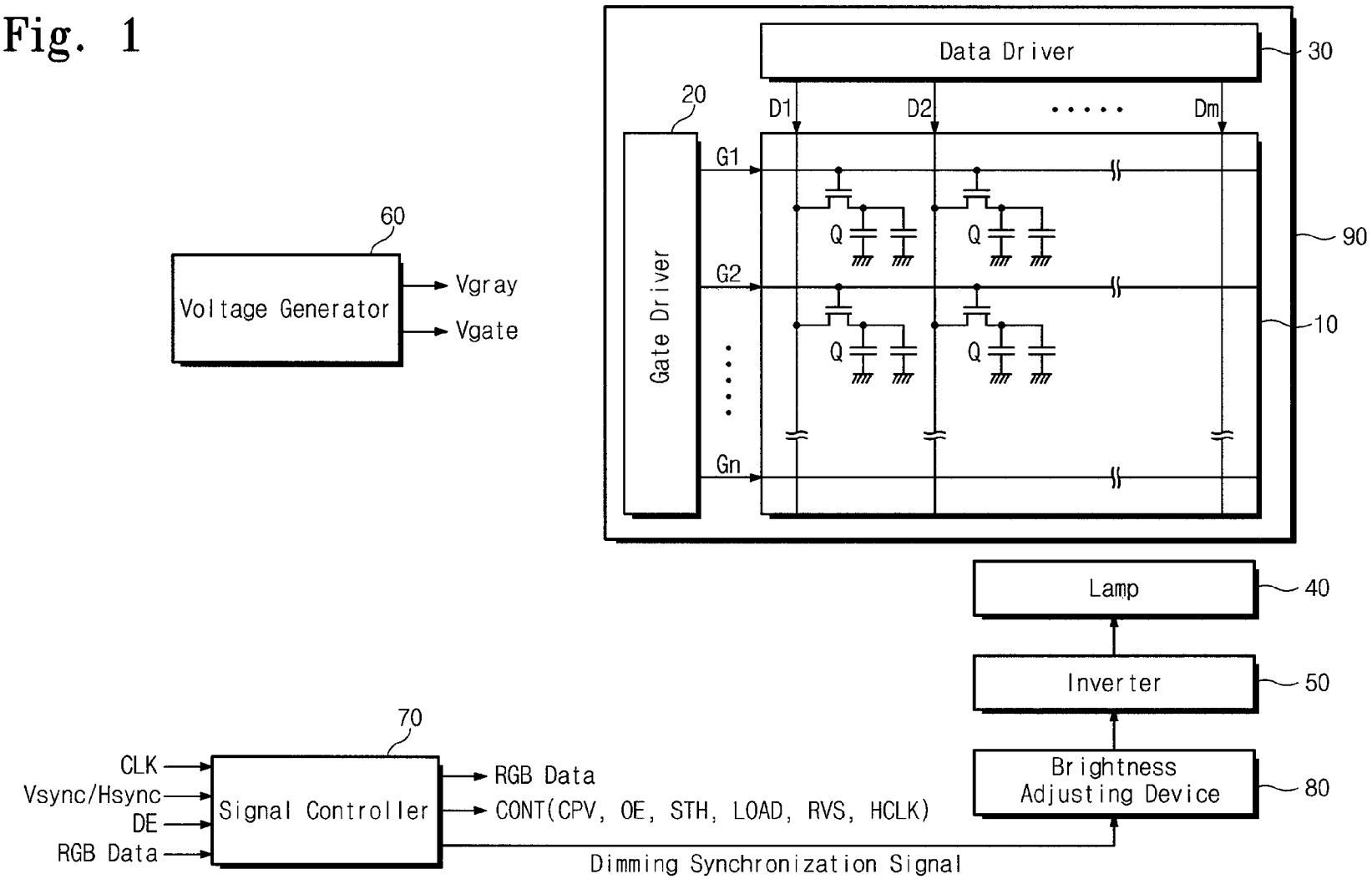
FIG. 1 is a block diagram showing the structure of a liquid crystal display according to an exemplary embodiment of the present invention.

FIG. 1 is a block diagram showing the structure of a liquid crystal display according to an exemplary embodiment of the present invention.

As shown in FIG. 1, a liquid crystal display 1 according to an exemplary embodiment of the present invention includes a liquid crystal display plate 90 having a liquid crystal display unit 10 and gate and data drivers 20 and 30 connected to the liquid crystal display unit 10, a voltage generator 60 connected to the gate and data drivers 20 and 30, a lamp 40 irradiating light onto the liquid crystal display unit 10, an inverter 50 connected to the lamp 40, a brightness adjusting device 80, and a signal controller 70 controlling the inverter 50 and the brightness adjusting device 80. According to the present exemplary embodiment, the liquid crystal display unit 10 and the gate and data drivers 20 and 30 connected to the liquid crystal display unit 10 are arranged on one liquid crystal display plate. However, the liquid crystal display unit 10 and the gate and data drivers 20 and 30 may be arranged on different substrates, respectively.

The voltage generator 60 generates a gray scale voltage Vgray related to the transmittance of pixels and two types of gate voltages Vgate. The gray scale voltage Vgray is divided into two groups, one of which has a positive polarity relative to a common voltage Vcom and the other of which has a negative polarity relative to the common voltage Vcom. The gate voltage Vgate includes a gate on voltage and a gate off voltage.

The gate driver 20 is connected to a gate line of the liquid crystal display unit 10 to apply the gate signal to the gate line. The gate signal includes the gate on voltage and the gate off voltage of the voltage generator 60.

The data driver 30 is connected to a data line of the liquid crystal display unit 10 to apply a data voltage to the data line. The data voltage is selected from the gray scale voltages Vgray of the voltage generator 60 in response to the desired brightness and reverse control.

The signal controller 70 receives RGB image signals and input control signals from an external graphic controller (not shown). The input control signals may include a vertical synchronization signal Vsync, a horizontal synchronization signal Hsync, a main clock signal CLK, and a data enable signal DE, which control the RGB image signals to be displayed. The signal controller 70 generates various control signals CONT based on the input control signals, processes the image signal RGB_Data such that the image signal RGB_Data is suitable for the operational condition of the liquid crystal display unit 10, transmits the control signals CONT to the gate driver 20 and the data driver 30, and transmits the processed image signal RGB_Data to the data driver 30.

The control signals CONT include a gate clock signal CPV controlling the output time of the gate on voltage Von and an output enable signal OE that limits the amplitude of the gate on voltage Von. In addition, the control signals CONT include a horizontal synchronization start signal STH that notifies the start of the horizontal period, a load signal LOAD used to apply the data voltage to the data line, a reverse signal RVS used to reverse the polarity of the data voltage relative to the common voltage Vcom (hereinafter, polarity of the data voltage relative to the common voltage is simply referred to as "polarity of the data voltage), and a data clock signal HCLK.

The data driver 30 sequentially receives image data corresponding to pixels of one row (in general, horizontal scanning lines) based on the control signal CONT of the signal controller 70, and selects the voltage corresponding to the image data from among the gray scale voltages Vgray of the voltage generator 60, thereby converting the image data into the data voltage applied to the liquid crystal.

The gate driver 20 applies the gate on voltage of the voltage generator 60 to the gate line in response to the control signal CONT of the signal controller 70, and allows switching elements Q of all pixels connected to the gate line to electrically communicate with each other.

The gate on voltage is applied to one gate line, and the data driver 20 provides the data voltage to the data lines D1 to Dm while the switching elements Q connected to the gate line are electrically connected with each other (this period is referred to as "1H" or "1 horizontal period", which is identical to one period of the horizontal synchronization signal Hsync, the data enable signal DE, and the gate clock signal CPV). The data voltage applied to the data line D1 to Dm is applied to the corresponding pixels through the switching elements Q.

The brightness adjusting device 80 generates a pulse signal by using a dimming control signal from the signal controller 70 (for instance, the vertical synchronization start signal) and transmits the pulse signal to the inverter 50. In the inverter, the pulse signal controls on/off of the sine wave voltage applied to the lamp 40, thereby turning on/off the lamp 40.

Figure 2:
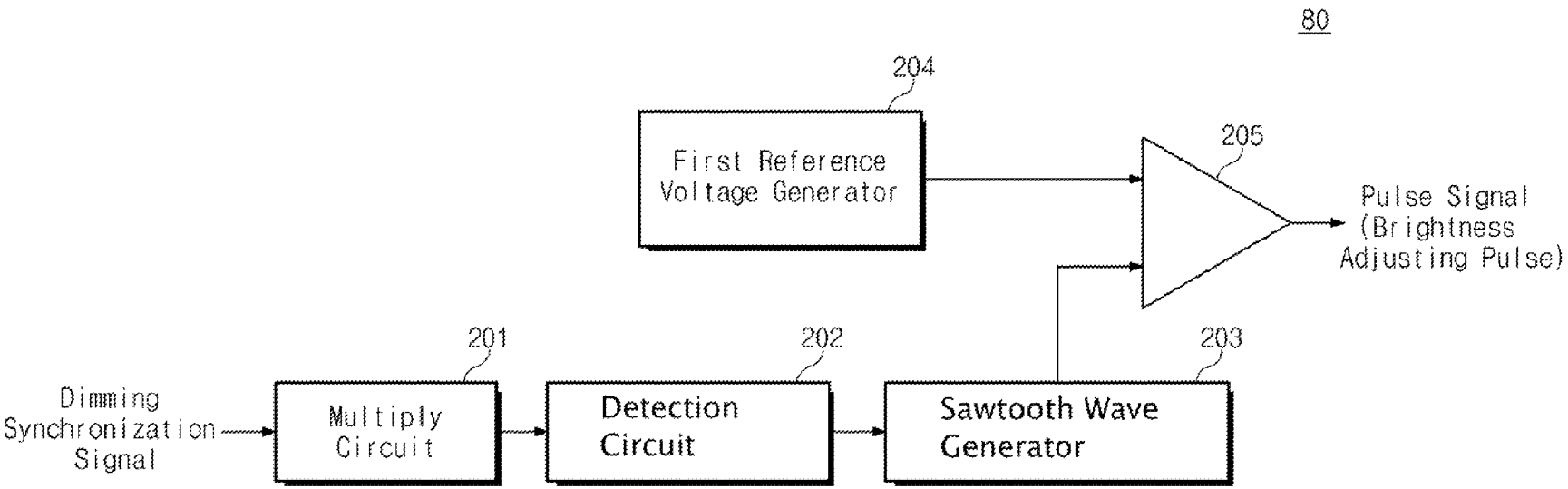
FIG. 2 is a block diagram showing the structure of a brightness adjusting according to an exemplary embodiment of the present invention.

FIG. 2 is a block diagram showing the structure of the brightness adjusting device 80 used in the liquid crystal display 1 according to an exemplary embodiment of the present invention.

The brightness adjusting device 80 shown in FIG. 2 includes a multiplication circuit 201 that receives the dimming synchronization signal from the signal controller 70 to multiply the dimming synchronization signal with a fixed multiplication ratio to generate a multiplication signal, a detection circuit 202 that distinguishes between different multiplication signals, a sawtooth wave generator 203 that charges/discharges a condenser according to the signal output from the detection circuit 202 and generates the sawtooth wave having constant amplitude even if a frequency of the multiplication signal is changed, a first reference voltage generator 204 generating a first reference voltage (brightness adjusting voltage) that determines a pulse duty based on the sawtooth wave voltage, and a comparator 205 comparing the sawtooth wave voltage with the first reference voltage to output a brightness adjusting pulse signal.

The detection circuit 202 includes a first resistor 305, a condenser 306, a diode 307, and a second resistor 308. The time constant is determined according to the values of the condenser 306 and the second resistor 308.

In the brightness adjusting device 80 used for the liquid crystal display 1 according to an exemplary embodiment of the present invention, the dimming synchronization signal received from the signal controller 70 serves as the vertical synchronization start signal STV. The brightness adjusting device 80 used for the liquid crystal display 1 according to an exemplary embodiment of the present invention receives the vertical synchronization start signal STV to multiply the vertical synchronization start signal STV with the multiplication ratio. However, according to another exemplary embodiment of the present invention, the brightness adjusting device 80 may receive the vertical synchronization signal Vsync or the horizontal synchronization signal Hsync to multiply the vertical synchronization signal Vsync or the horizontal synchronization signal Hsync with the multiplication ratio, wherein the Vsync or Hsync is other than the vertical synchronization start signal STV.

When the vertical synchronization signal Vsync or the horizontal synchronization signal Hsync is used as the dimming synchronization signal, the frequency of the dimming synchronization signal is about 60 Hz in the case of NTSC image signals and about 50 Hz in the case of the PAL or SECAM image signals.

Figure 3:
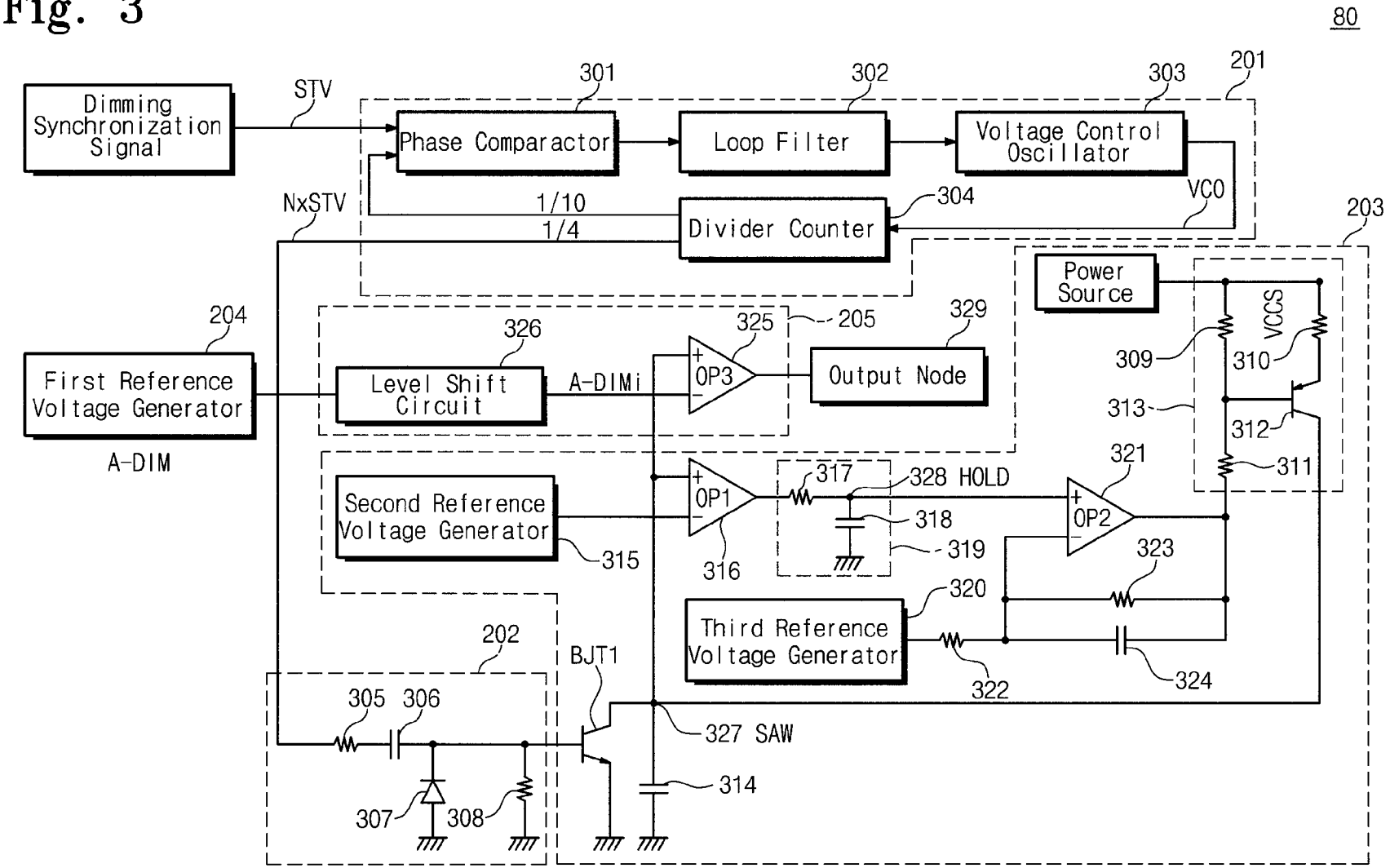
FIG. 3 is a circuit diagram showing the structure of a brightness adjusting device according to an exemplary embodiment of the present invention.

FIG. 3 is a circuit diagram showing the structure of the brightness adjusting device 80 shown in FIG. 2. The multiplication circuit 201 is a PLL circuit that includes a phase comparator 301, a loop filter 302, a voltage control oscillator VCO 303, and a divider counter 304.

The detection circuit 202 includes a first resistor 305, a condenser 306, a diode 307, and a second resistor 308. The time constant is determined according to the values of the condenser 306 and the second resistor 308.

The sawtooth wave generator 203 includes a voltage control current source 313 having resistors 309, 310 and 311 and a PNP transistor 312, a condenser 314 charged with the current supplied from the voltage control current source 313, a transistor BJT1 that discharges electric charges of the condenser 314 as the detection circuit 202 generates an output signal, a second reference voltage generator 315, a first operational amplifier 316, an integral circuit 319 having a resistor 317 and a condenser 318 connected to an outer terminal of the first operational amplifier 316, a third reference voltage generator 320, a second operational amplifier 321, resistors 322 and 323 fedback to the negative input terminal from the second operational amplifier 321, and a condenser 324.

Although the structure of the first reference voltage generator 204 is not illustrated in detail, the first reference voltage generator 204 generates stable and adjustable DC voltages. For instance, the first reference voltage generator 204 includes a circuit that outputs a voltage by dividing a constant voltage source using a variable resistor, or a circuit that selectively outputs various types of voltages by selecting a voltage ratio using various resistor values and switching transistors.

The comparator 205 is a third operational amplifier 325, in which the positive input terminal is connected to the condenser 314, and the negative input terminal is connected to the first reference voltage generator. The comparator 205 outputs a pulse signal having a constant duty ratio by comparing the voltage of a node (SAW) 327 with a reference DC voltage output from the first reference voltage generator 204. In addition, a level shift circuit 326 may be installed between the first reference voltage generator 204 and the negative input terminal of the third operational amplifier 325 (comparator 205) in order to adjust the first reference voltage (DC voltage).

Figure 4:
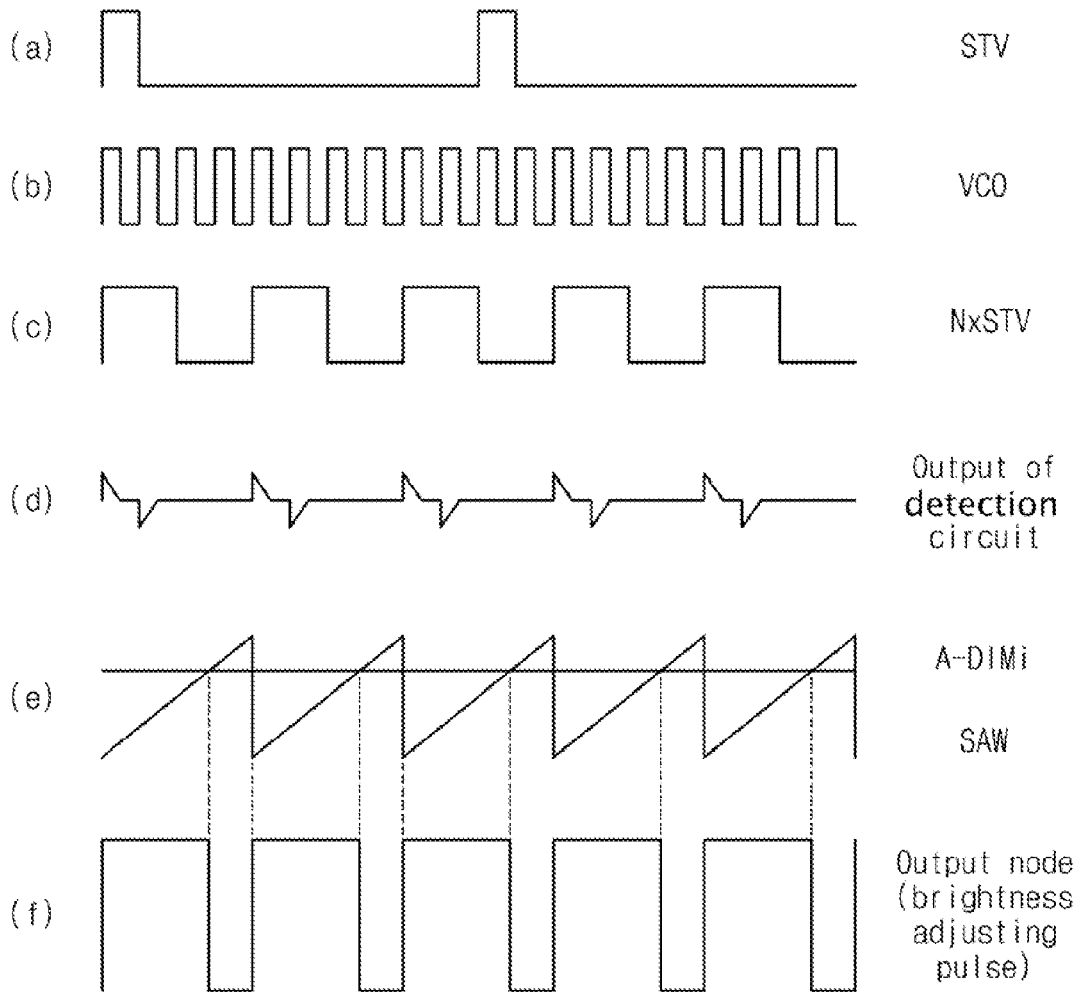
FIG. 4 is a timing chart of a brightness adjusting device according to an exemplary embodiment of the present invention when the frequency of the vertical synchronization start signal is high.
Figure 5:
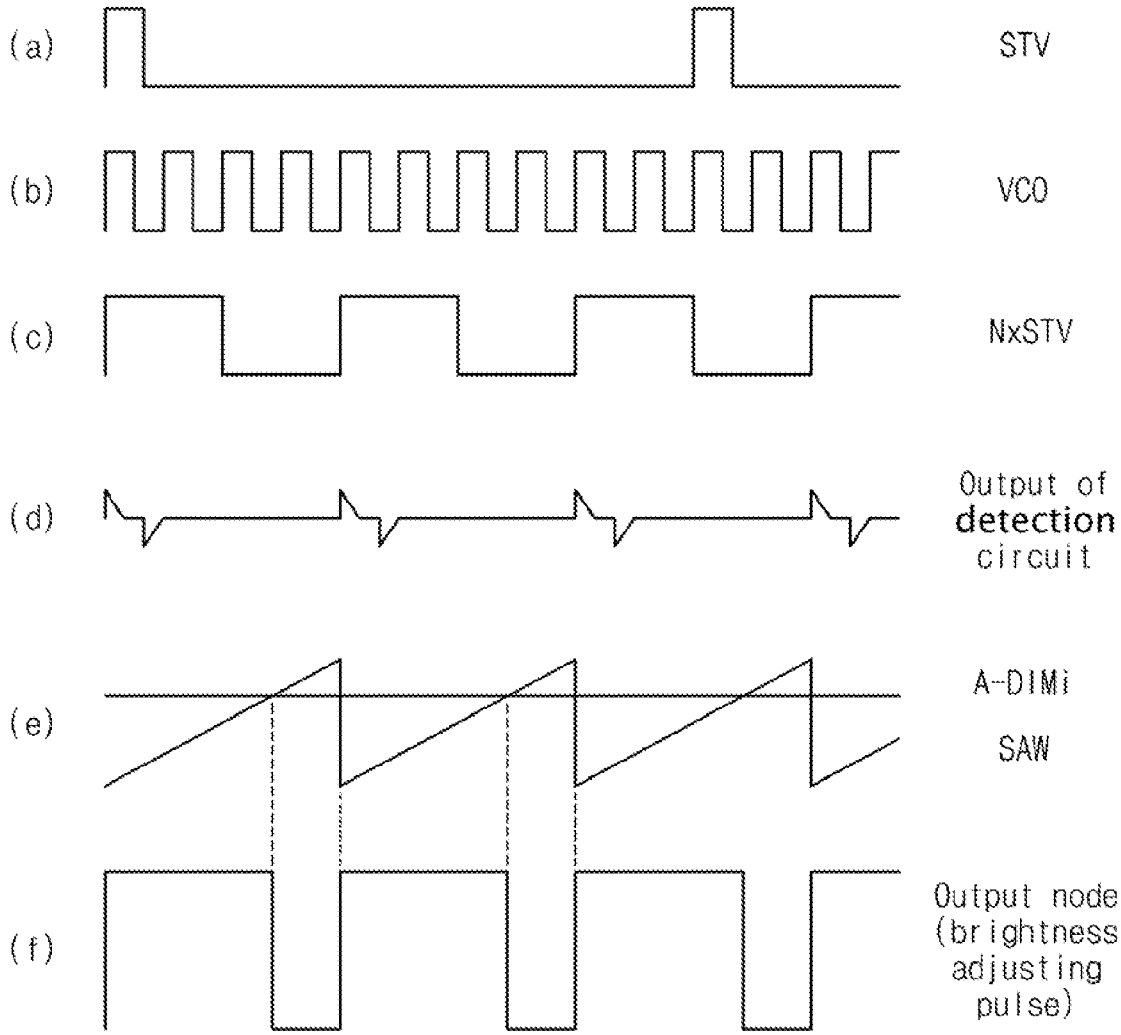
FIG. 5 is a timing chart of a brightness adjusting device according to an exemplary embodiment of the present invention when the frequency of the vertical synchronization start signal is low.

FIG. 4 is a timing chart showing the voltage waveform of each node when the frequency of the vertical synchronization start signal STV is high, and FIG. 5 is a timing chart showing the voltage waveform of each node when the frequency of the vertical synchronization start signal is low. FIG. 4(*a*) and FIG. 5(*a*) show the voltage waveforms of the vertical synchronization start signals STV, and FIG. 4(*b*) and FIG. 5(*b*) show the voltage waveforms of the output signals of the voltage control oscillator VCO 303 constituting the multiplication circuit 201, in which frequencies approximately 10 times greater than the frequency of the vertical synchronization start signals STV are output. FIG. 4(*c*) and FIG. 5(*c*) show the voltage waveforms (N×TV) of the output signals, which are output from one side of the divider counter constituting the multiplication circuit 201, in which the frequency is about ¼ frequency of the output signal of the voltage control oscillator VCO 303 and is about 2.5 times (N=2.5) greater than the frequency of the vertical synchronization start signals STV. FIG. 4(*d*) and FIG. 5(*d*) show the voltage waveforms of the output signals of the detection circuit 202, which are put into a base of the transistor BJT1. FIG. 4(*e*) and FIG. 5(*e*) show the voltage waveform of the first reference voltage (A-DIMi) input into the negative input terminal of the third operational amplifier 325 and the voltage waveform of the node (SAW) 327 input into the positive input terminal, respectively. FIG. 4(*f*) and FIG. 5(*f*) show the voltage waveforms of the third operational amplifier 325.

As shown in FIG. 4(*a*) and FIG. 5(*a*), the frequency of the vertical synchronization start signals STV is high in FIG. 4(*a*) and low in FIG. 5(*a*). However, as shown in FIG. 4(*e*) and FIG. 5(*e*), the amplitude of the voltage waveform of the node (SAW) 327, which is input into the positive input terminal of the third operational amplifier 325, is constantly maintained regardless of the amplitude of the frequency of the vertical synchronization start signals STV. Accordingly, if the DC voltage of the first reference voltage (A-DIMi), which is input into the negative input terminal of the third operational amplifier 325, is not changed as shown in FIG. 4(*e*) and FIG. 5(*e*), the duty ratio of the brightness adjusting pulse is constantly maintained as shown in FIG. 4(*f*) and FIG. 5(*f*).

The vertical synchronization start signal STV output from the signal controller 70 shown in FIG. 1 is multiplied by a fixed ratio through the multiplication circuit 201. The multiplication circuit 201 is a frequency synthesizer using PLL and oscillates the voltage control oscillator VCO 303 in the loop through the feedback control in such a manner that the phase difference between the vertical synchronization start signals STV output from the signal controller 70 and the output signal divided into the voltage control oscillator VCO 303 and the divider counter 304 may be maintained at a constant level. Since the multiplication circuit 201 uses the PLL, signals that are synchronized with the vertical synchronization start signals STV output from the signal controller 70 or multiplied by the fixed ratio may be obtained.

The multiplication ratio may be predetermined, and the divide ratio is determined according to the predetermined multiplication ratio. FIGS. 3 and 4 show examples in which the multiplication ratio is set to 2.5. The phase comparator 301 compares the phase of the vertical synchronization start signals STV output from the signal controller 70 with the phase of the signal output from the other side of the divider counter 304, and outputs the phase difference as a pulse signal. The loop filter (integral circuit/LPF) 302 intercepts high frequency components from the pulse signal to form the DC signal and transmits the DC signal into the voltage control oscillator as a control voltage. Such a process may repeat until the phase difference is removed. If the phase of the signal output from the voltage control oscillator 303 increases, the oscillating frequency is reduced to decrease the phase of the signal. If the oscillator output is delayed, the oscillating frequency is raised to increase the phase. That is, the voltage control oscillator 303 is controlled such that the phase difference between the vertical synchronization start signal STV and the signal output from the other side of the divider counter 304 becomes zero.

Since the signal output from the multiplication circuit 201 is a pulse signal, an operation start edge of the pulse signal must be detected. To this end, the detection circuit 202 is provided in the brightness adjusting device 80.

The operation start edge of the pulse signal detected by the detection circuit 202 is applied to the base of the transistor BJT1, so that the switching operation of the transistor BJT1 is performed. The condenser 314 connected to the collector of the transistor BJT1 is charged with the current supplied from the voltage control current source 313, and the operation start edge detected by the detection circuit 202 is applied to the base of the transistor BJT1 to turn on the transistor BJT1, so that the electric charge of the condenser 314 is discharged.

As shown in FIG. 4(*e*) and FIG. 5(*e*), the voltage waveform of the node (SAW) 327 is represented as a sawtooth waveform. The sawtooth wave form of the node (SAW) 327 is input into the positive input terminal of the first operational amplifier 316 and is compared with the reference voltage, which is output from the second reference voltage generator and is input into the negative input terminal. The comparison result is output as a pulse signal.

This pulse signal is smoothened by means of the integral circuit 319. The smoothing signal is input into the positive input terminal of the second operational amplifier 321, and is compared with the reference voltage, which is output from the third reference voltage generator and is input into the negative input terminal. The second operational amplifier 321 outputs the signal based on the comparison result to control the voltage control current source 313.

The voltage input into the positive input terminal is stabilized by means of the operation of the second operational amplifier 321, so that the voltage may serve as a reference voltage generated from the third reference voltage generator. That is, since the voltage of the node (HOLD) 328 that is input into the positive input terminal is maintained at a predetermined level due to the operation of the second operational amplifier 321, the average value of the square waves output from the first operational amplifier 316 is maintained constant. As a result, the amplitude of the node (SAW) 327 is constantly maintained regardless of the capacity of the condenser 314, the frequency of the vertical synchronization start signal STV, and the multiplication ratio of the multiplication circuit.

As mentioned above, since the sawtooth wave form of the node (SAW) 327 has the constant amplitude regardless of its frequency, the brightness adjusting pulse signal output from the output node 329 of the third operational amplifier 325 becomes the pulse signal having a duty ratio fixed to the reference DC voltage level when the sawtooth wave form of the node (SAW) 327 is compared to the reference DC voltage (A-DIMI) output from the first reference voltage generator by means of the third operational amplifier 325. The brightness adjusting pulse signal is not affected by the frequency of the vertical synchronization start signal STV and the multiplication ratio of the multiplication circuit. In addition, as mentioned above, since the brightness adjusting device 80 used for the liquid crystal display according to an exemplary embodiment of the present invention includes the multiplication circuit 201, the switching period of the inverter and the brightness may be changed by adjusting the multiplication ratio of the multiplication circuit 201.

In addition, in order to control the reference DC voltage (A-DIMI), which is output from the first reference voltage generator and input into the negative input terminal of the third operational amplifier 325, a level shift circuit 326 may be installed.

Figure 6:
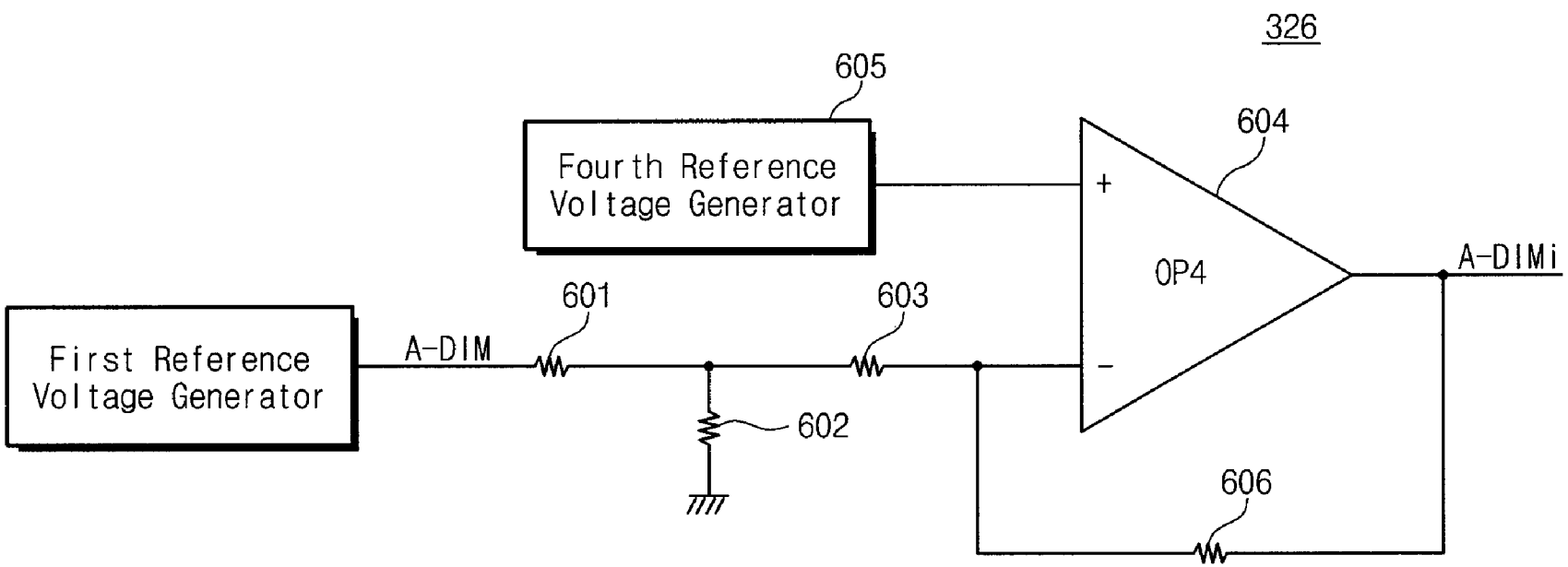
FIG. 6 is a circuit diagram of a level shift circuit.
Figure 7:
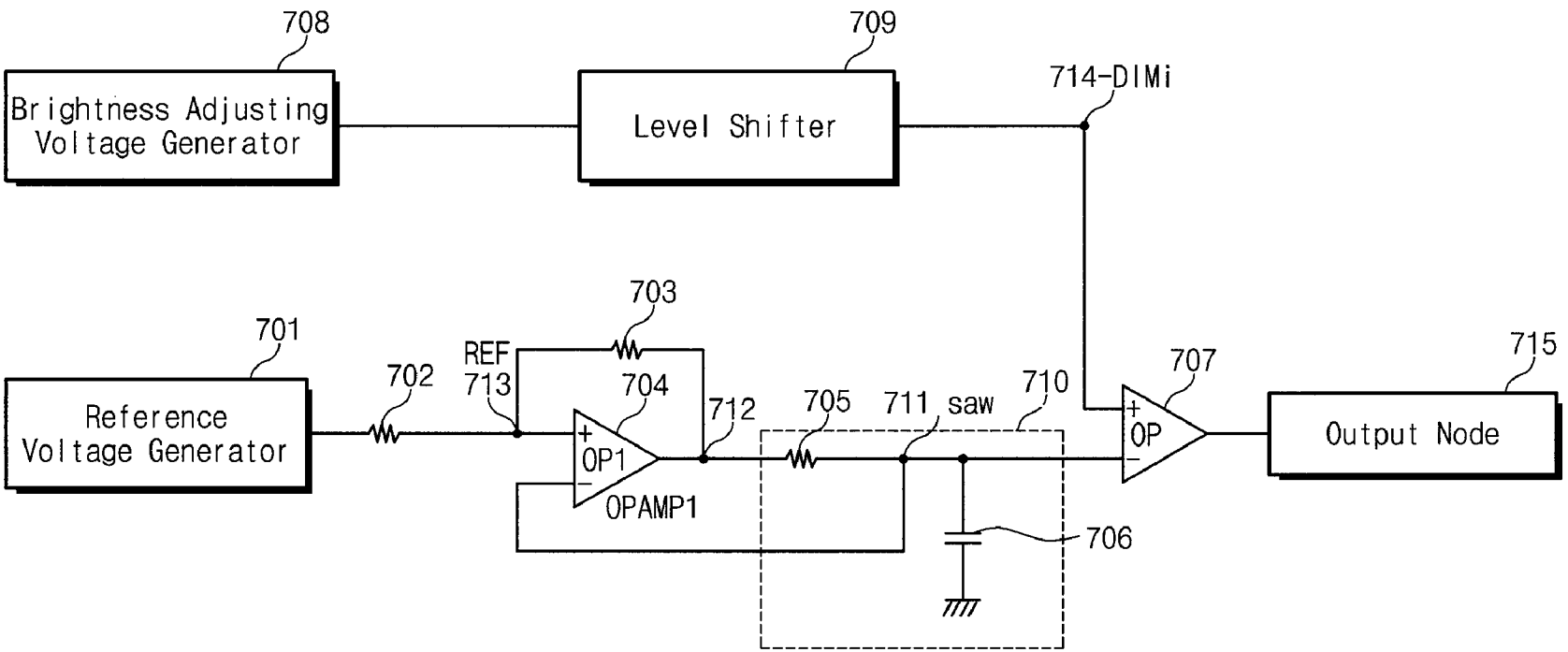
Fig. 7 (PRIOR ART)
FIG. 7 is a circuit diagram of a conventional brightness adjusting device.
Figure 8:
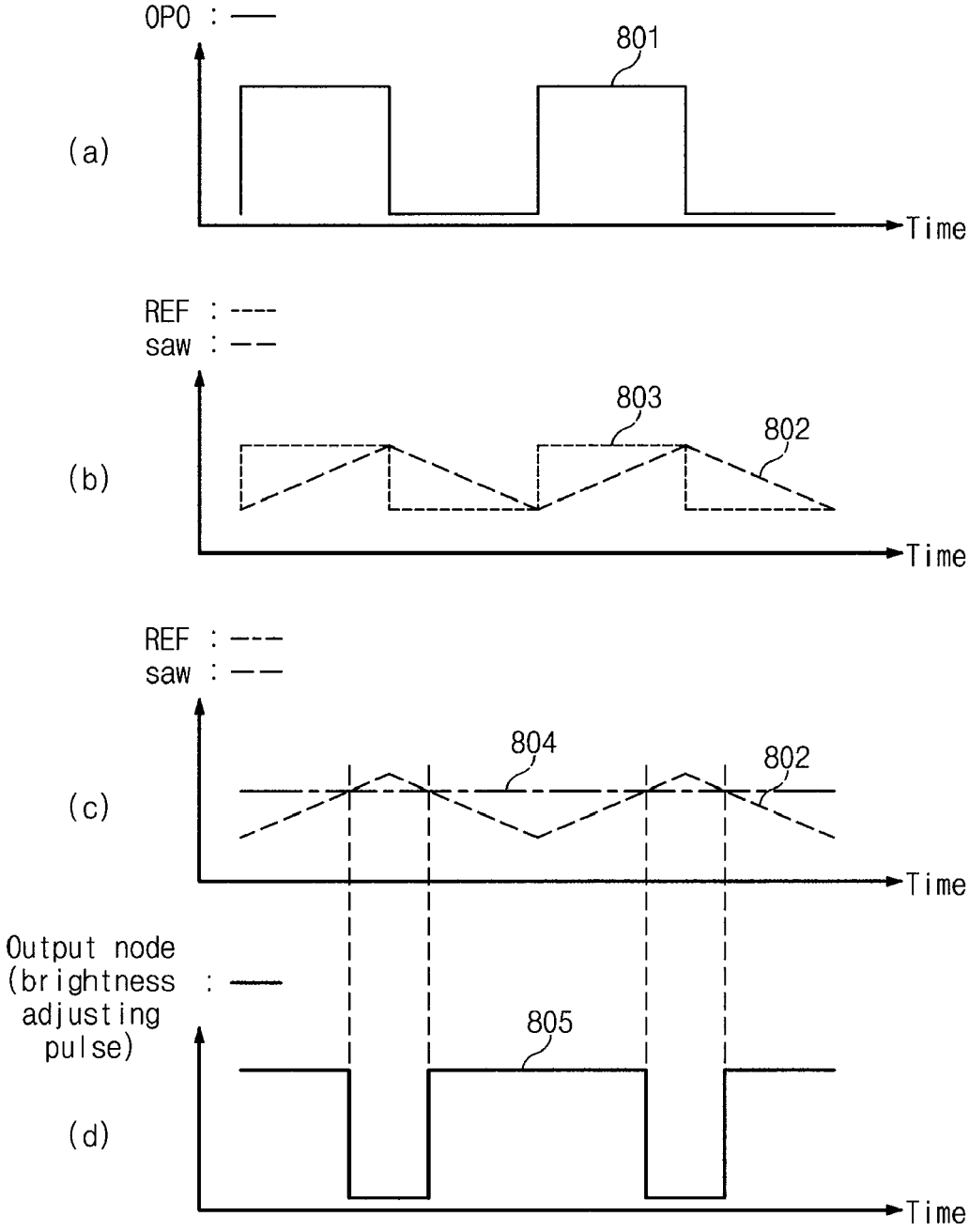
Fig. 8 (PRIOR ART)
FIG. 8 is a timing chart of a conventional brightness adjusting pulse generator.
Figure 9:
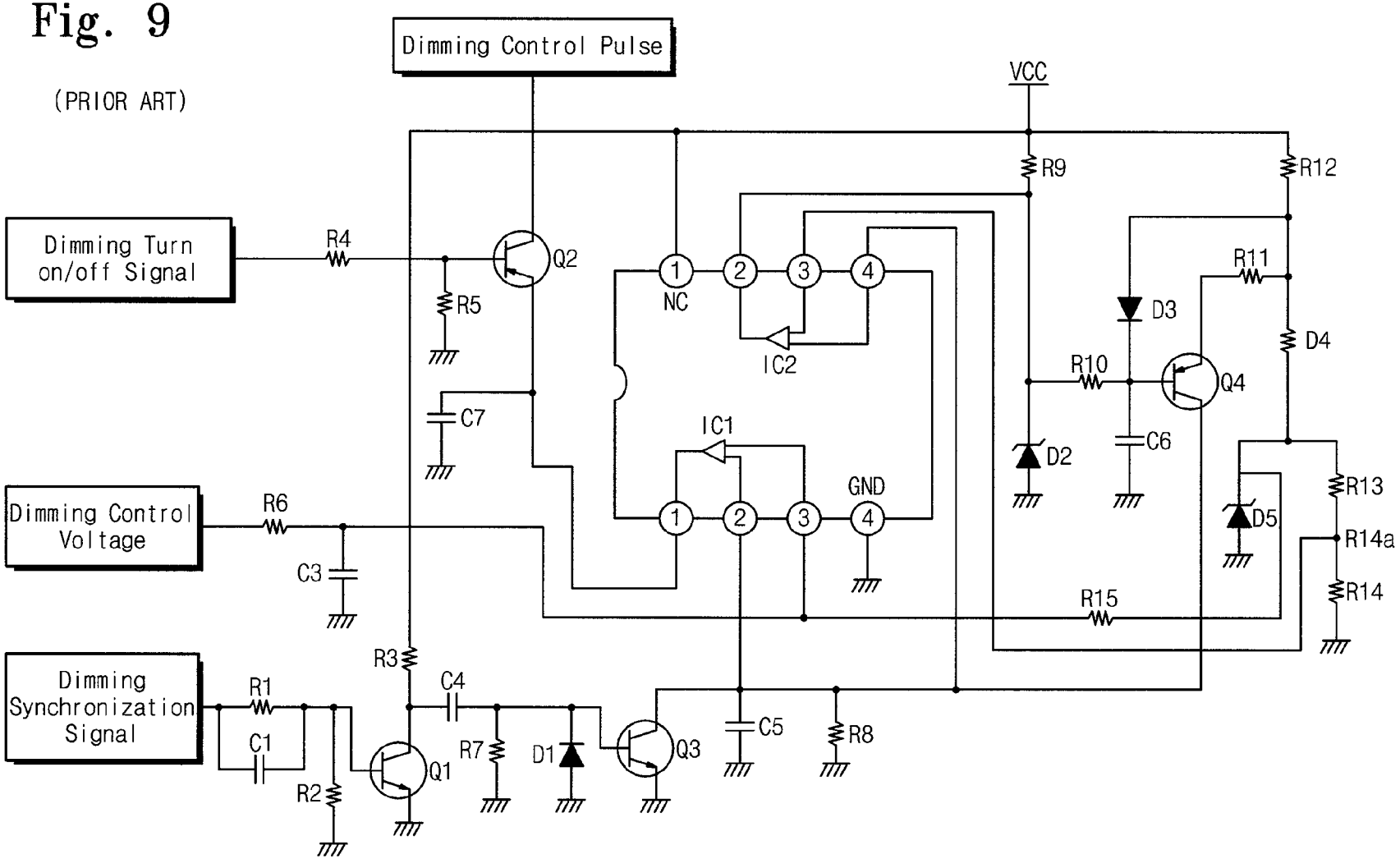
Fig. 9 (PRIOR ART)
FIG. 9 is a circuit diagram of another conventional dimming control device.

FIG. 6 shows such a level shift circuit 326.

Referring to FIG. 6, the voltage output from the first reference voltage generator is divided through resistors 601 and 602 and input into the negative input terminal of a fourth operational amplifier 604 through a resistor 603. The reference voltage output from the fourth reference voltage generator 605 is input into the positive input terminal of the fourth operational amplifier 604, and a negative feedback loop is connected to the output terminal of the fourth operational amplifier 604 by way of a resistor 606. In the above level shift circuit 326, any one of the resistors 601, 602, 603 and 606 may serve as a variable resistor to control the first reference voltage.

As described above, according to the liquid crystal display of the present invention, the dimming synchronization signal, for instance, the vertical synchronization frequency of the display image signal transmitted to the liquid crystal panel is fixedly synchronized with the frequency of the brightness adjusting pulse at a predetermined multiplication ratio, so that interference noise may be prevented. In addition, the frequency of the brightness adjusting pulse may be changed by controlling the multiplication ratio of the multiplication circuit.

According to liquid crystal display of the present invention, the frequency of the dimming synchronization signal is synchronized with the frequency of the brightness adjusting pulse at a predetermined multiplication ratio, so that interference noise may be prevented. Further, the duty ratio of the brightness adjusting pulse is not changed even if the frequency of the dimming synchronization signal is changed, and the frequency of the brightness adjusting pulse may be changed by controlling the multiplication ratio of the multiplication circuit.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A brightness adjusting device comprising:

a multiplication circuit multiplying an input dimming synchronization signal with a multiplication ratio to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to generate a sawtooth wave having constant amplitude independently of the multiplication signal based on the output signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit comprises a circuit having a variable multiplication ratio, wherein the detection circuit comprises:

a first resistor having a first end receiving an input signal;

a condenser having a first end connected to a second end of the first resistor;

a diode having an anode connected to a ground and a cathode connected to a second end of the condenser; and a second resistor having a first end connected with the cathode of the diode and the second end of the condenser, and a second end connected to the ground.

2. A brightness adjusting device comprising:

a multiplication circuit multiplying an input dimming synchronization signal with a multiplication ratio to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to generate a sawtooth wave having constant amplitude independently of the multiplication signal based on the output signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit comprises a circuit having a variable multiplication ratio, wherein the sawtooth wave generator comprises:

a second reference voltage generator that generates a second reference voltage;

a third reference voltage generator that generates a third reference voltage;

a voltage control current source that controls an output voltage based on an input voltage;

a first condenser charged with a current output from the voltage control current source;

a transistor having a base connected to an output terminal of the detection circuit, a collector connected to the first condenser, and an emitter connected to a ground;

a first operational amplifier having a positive input terminal receiving a collector voltage of the transistor and a negative input terminal receiving the second reference voltage, the first operational amplifier comparing the collector voltage of the transistor with the second reference voltage to output a signal;

an integral circuit having a resistor and a second condenser connected to an output terminal of the first operational amplifier; and a second operational amplifier having an output terminal, a positive input terminal receiving an output of the integral circuit and a negative input terminal receiving the third reference voltage through a resistor, the second operational amplifier having a negative feedback loop including a resistor and a condenser that are connected to the output terminal in parallel, wherein the output terminal being connected to the voltage control current source, wherein the transistor is operated as the detection circuit outputs a signal so that the first condenser is charged/discharged and the sawtooth wave is generated at the collector of the transistor.

3. A brightness adjusting device comprising:

a multiplication circuit multiplying an input dimming synchronization signal with a multiplication ratio to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to generate a sawtooth wave having constant amplitude independently of the multiplication signal based on the output signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit comprises a circuit having a variable multiplication ratio, wherein the comparator, which outputs the pulse signal by comparing the voltage of the sawtooth wave with the first reference voltage, comprises an operational amplifier, the voltage of the sawtooth wave is input into a positive input terminal of the operational amplifier, and the first reference voltage is input into a negative input terminal of the operational amplifier, thereby generating the pulse signal, wherein the brightness adjusting device further comprises a level shifter provided between the first reference voltage generator and the positive input terminal of the operational amplifier to adjust the first reference voltage, and wherein the level shifter adjusts a level of an output voltage based on resistance values of two resistors that divide the first reference voltage output of the first reference voltage generator, and a resistance value of a resistor used for a negative feedback to another operational amplifier.

4. A liquid crystal display comprising:

a liquid crystal display unit;

a gate driver applying a gate signal including two types of gate voltages to a gate line of the liquid crystal display unit;

a liquid crystal display panel having a data driver that applies a gray scale voltage to a data line, the gray scale voltage being selected from a gray scale voltage group according to desired brightness and reverse control;

a voltage generator that generates the gray scale voltage group and two types of gate voltages;

a signal controller receiving an RGB image signal and an input control signal that controls the RGB image signal being displayed to generate a plurality of control signals including a dimming synchronization signal, processing image signals in correspondence with operating conditions of the liquid crystal display unit, and outputting the control signals;

a lamp including a plurality of discharge tubes;

at least one inverter providing the discharge tubes with an AC high voltage;

a multiplication circuit receiving and multiplying a dimming synchronization signal to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to charge or discharge a condenser according to a signal output from the detection circuit and to generate a sawtooth wave having a constant amplitude independently of a frequency of the multiplication signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit includes a circuit having a variable multiplication ratio, wherein the detection circuit comprises:

a first resistor having a first end receiving an input signal;

a condenser having a first end connected to a second end of the first resistor;

a diode having an anode connected to a ground and a cathode connected to a second end of the condenser; and a second resistor having a first end connected with the cathode of the diode and the second end of the condenser, and a second end connected to the ground.

5. A liquid crystal display comprising:

a liquid crystal display unit;

a gate driver applying a gate signal including two types of gate voltages to a gate line of the liquid crystal display unit;

a liquid crystal display panel having a data driver that applies a gray scale voltage to a data line, the gray scale voltage being selected from a gray scale voltage group according to desired brightness and reverse control;

a voltage generator that generates the gray scale voltage group and two types of gate voltages;

a signal controller receiving an RGB image signal and an input control signal that controls the RGB image signal being displayed to generate a plurality of control signals including a dimming synchronization signal, processing image signals in correspondence with operating conditions of the liquid crystal display unit, and outputting the control signals;

a lamp including a plurality of discharge tubes;

at least one inverter providing the discharge tubes with an AC high voltage;

a multiplication circuit receiving and multiplying a dimming synchronization signal to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to charge or discharge a condenser according to a signal output from the detection circuit and to generate a sawtooth wave having a constant amplitude independently of a frequency of the multiplication signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit includes a circuit having a variable multiplication ratio, wherein the sawtooth wave generator comprises:

a second reference voltage generator that generates a second reference voltage;

a third reference voltage generator that generates a third reference voltage;

a voltage control current source that controls an output voltage based on an input voltage;

a first condenser charged with a current output from the voltage control current source;

a transistor having a base connected to an output terminal of the detection circuit, a collector connected to the first condenser, and an emitter connected to a ground;

a first operational amplifier having a positive input terminal receiving a collector voltage of the transistor and a negative input terminal receiving the second reference voltage, the first operational amplifier outputting a signal by comparing the collector voltage of the transistor with the second reference voltage;

an integral circuit having a resistor and a second condenser connected to an output terminal of the first operational amplifier; and a second operational amplifier having a positive input terminal receiving an output of the integral circuit and a negative input terminal receiving the third reference voltage through a resistor, the second operational amplifier having a negative feedback loop including a resistor and a condenser that are connected to the output terminal in parallel, the output terminal being connected to the voltage control current source, wherein the transistor is operated as the detection circuit outputs a signal so that the first condenser is charged/discharged and the sawtooth wave is generated at the collector of the transistor.

6. A liquid crystal display comprising:

a liquid crystal display unit;

a gate driver applying a gate signal including two types of gate voltages to a gate line of the liquid crystal display unit;

a liquid crystal display panel having a data driver that applies a gray scale voltage to a data line, the gray scale voltage being selected from a gray scale voltage group according to desired brightness and reverse control;

a voltage generator that generates the gray scale voltage group and two types of gate voltages;

a signal controller receiving an RGB image signal and an input control signal that controls the RGB image signal being displayed to generate a plurality of control signals including a dimming synchronization signal, processing image signals in correspondence with operating conditions of the liquid crystal display unit, and outputting the control signals;

a lamp including a plurality of discharge tubes;

at least one inverter providing the discharge tubes with an AC high voltage;

a multiplication circuit receiving and multiplying a dimming synchronization signal to output a multiplication signal;

a detection circuit connected to the multiplication circuit, the detection circuit to detect an operation start edge of the multiplication signal and to generate an output signal based on the detected operation start edge;

a sawtooth wave generator connected to the detection circuit to charge or discharge a condenser according to a signal output from the detection circuit and to generate a sawtooth wave having a constant amplitude independently of a frequency of the multiplication signal;

a first reference voltage generator that generates a first reference voltage; and a comparator connected to the sawtooth wave generator to output a pulse signal by comparing a voltage of the sawtooth wave with the first reference voltage, wherein the first reference voltage generator comprises a circuit that outputs a variable voltage, and the multiplication circuit includes a circuit having a variable multiplication ratio, wherein the comparator, which outputs the pulse signal by comparing the voltage of the sawtooth wave with the first reference voltage, comprises an operational amplifier, the voltage of the sawtooth wave is input into a positive input terminal of the operational amplifier, and the first reference voltage is input into a negative input terminal of the operational amplifier, thereby generating the pulse signal, wherein liquid crystal display further comprises a level shifter provided between the first reference voltage generator and the positive input terminal of the operational amplifier to adjust the first reference voltage, and wherein the level shifter adjusts a level of an output voltage based on resistance values of two resistors that divide the first reference voltage output of the first reference voltage generator, and a resistance value of a resistor used for a negative feedback to another operational amplifier.

* * * * *